US008436595B2

(12) United States Patent
Simmons et al.

(10) Patent No.: US 8,436,595 B2
(45) Date of Patent: May 7, 2013

(54) CAPLESS REGULATOR OVERSHOOT AND UNDERSHOOT REGULATION CIRCUIT

(75) Inventors: John Wayne Simmons, Tamarac, FL (US); Kai Zhong, Gilbert, AZ (US)

(73) Assignee: Fujitsu Semiconductor Limited, Yokohama-shi (JP)

( * ) Notice: Subject to any disclaimer, the term of this patent is extended or adjusted under 35 U.S.C. 154(b) by 397 days.

(21) Appl. No.: 12/901,868

(22) Filed: Oct. 11, 2010

(65) Prior Publication Data

US 2012/0086420 A1 Apr. 12, 2012

(51) Int. Cl.
*G05F 1/565* (2006.01)

(52) U.S. Cl.
USPC ..... 323/273; 323/275; 323/349

(58) Field of Classification Search ..... 323/273, 323/275, 349
See application file for complete search history.

(56) References Cited

U.S. PATENT DOCUMENTS

| | | | | |
|---|---|---|---|---|
| 5,912,550 | A * | 6/1999 | Sharpe-Geisler | 323/273 |
| 2004/0263137 | A1 * | 12/2004 | Okubo et al. | 323/273 |
| 2012/0086420 | A1 * | 4/2012 | Simmons et al. | 323/282 |

* cited by examiner

*Primary Examiner* — Jeffrey Sterrett
(74) *Attorney, Agent, or Firm* — Baker Botts L.L.P.

(57) ABSTRACT

Systems and methods for reducing voltage undershoot and overshoot of a voltage regulator are disclosed. In one embodiment of the present disclosure, an undershoot/overshoot regulation circuit comprises a control node having a control voltage. The regulation circuit also comprises a control circuit configured to increase the control voltage in response to a load being applied to an output node of a voltage regulator and decrease the control voltage in response to the load being removed from the output node. The regulation circuit also comprises a control capacitor including a first terminal coupled to the control node and a second terminal coupled to a gate node of the voltage regulator. The control capacitor is configured to increase a gate voltage at the gate node in response to the increase of the control voltage, and decrease the gate voltage in response to the decrease of the control voltage.

20 Claims, 5 Drawing Sheets

CAPLESS REGULATOR OVERSHOOT AND UNDERSHOOT REGULATION CIRCUIT

TECHNICAL FIELD

The present disclosure relates generally to voltage regulators and, more particularly, to overshoot and undershoot regulation of the output voltage of voltage regulators.

BACKGROUND

Electronic devices are constantly being improved upon to have more capability and increased performance. Portable electronic devices, especially in the telecommunications industry, are among one of the fastest growing and innovative segments of the electronics industry. The demands in this market include low cost, long battery life, small size, increased performance, and increased capabilities of these devices.

Electronic devices typically utilize voltage regulators to provide the appropriate amount of power to the various circuits included within them. The increased performance requirements and capabilities of the electronic devices, especially in portable electronic devices, also require an increase in the performance capabilities of the voltage regulators included within the devices.

SUMMARY

In accordance with the teachings of the present disclosure, the disadvantages and problems associated with voltage undershoot and overshoot of voltage regulators may be reduced or eliminated.

In accordance with one embodiment of the present disclosure an undershoot/overshoot regulation circuit comprises a control node having a control voltage. The regulation circuit also comprises a control circuit configured to increase the control voltage in response to a load being applied to an output node of a voltage regulator. The control circuit is also configured to decrease the control voltage in response to the load being removed from the output node. The regulation circuit also comprises a control capacitor including a first terminal coupled to the control node and a second terminal coupled to a gate node of the voltage regulator. The control capacitor is configured to increase a gate voltage at the gate node in response to the increase of the control voltage, and decrease the gate voltage in response to the decrease of the control voltage.

In accordance with another embodiment of the present disclosure a system comprises a voltage regulator comprising a gate node having a gate voltage and an output node having an output voltage. The system further comprises an undershoot/overshoot regulation circuit comprising a control node having a control voltage. The regulation circuit also comprises a control circuit configured to increase the control voltage in response to a load being applied to the output node, and decrease the control voltage in response to the load being removed from the output node. The regulation circuit also comprises a control capacitor including a first terminal coupled to the control node and a second terminal coupled to the gate node. The control capacitor is configured to increase the gate voltage in response to the increase of the control voltage, and decrease the gate voltage in response to the decrease of the control voltage.

In accordance with yet another embodiment of the present disclosure a method comprises increasing, by a control circuit, a control voltage at a control node of a voltage undershoot/overshoot regulation circuit in response to a load being applied to an output node of a voltage regulator and decreasing, by the control circuit, the control voltage in response to the load being removed from the output node. The method further comprises increasing, by a control capacitor, a gate voltage at a gate node of the voltage regulator in response to the increase of the control voltage and decreasing the gate voltage in response to the decrease of the control voltage.

Other technical advantages will be apparent to those of ordinary skill in the art in view of the following specification, claims, and drawings.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
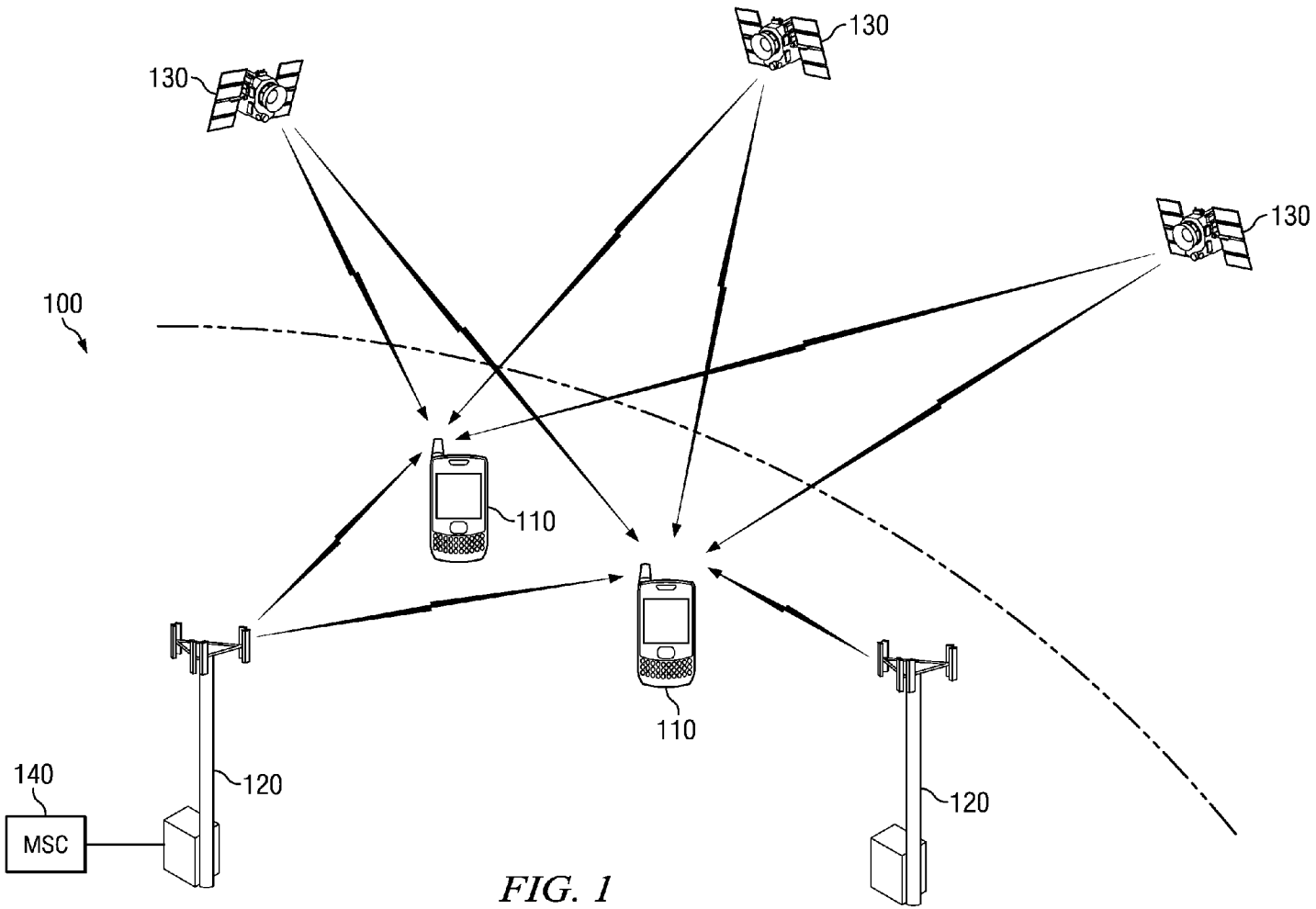
FIG. 1 illustrates a block diagram of an example wireless communication system, in accordance with certain embodiments of the present disclosure.

The wireless telecommunications industry is an industry that requires electronic devices—especially portable electronic devices, such as cellular phones—to have increased performance requirements and capabilities that may also require an increase in voltage regulator performance capabilities. FIG. 1 illustrates a block diagram of an example wireless communication system 100, in accordance with certain embodiments of the present disclosure. For simplicity, only two terminals 110 and two base stations 120 are shown in FIG. 1. A terminal 110 may also be referred to as a remote station, a mobile station, an access terminal, user equipment (UE), a wireless communication device, a cellular phone, or some other terminology. A base station 120 may be a fixed station and may also be referred to as an access point, a Node B, or some other terminology. A mobile switching center (MSC) 140 may be coupled to the base stations 120 and may provide coordination and control for base stations 120.

A terminal 110 may or may not be capable of receiving signals from satellites 130. Satellites 130 may belong to a satellite positioning system such as the well-known Global Positioning System (GPS). Each GPS satellite may transmit a GPS signal encoded with information that allows GPS receivers on earth to measure the time of arrival of the GPS signal. Measurements for a sufficient number of GPS satellites may be used to accurately estimate a three-dimensional position of a GPS receiver. A terminal 110 may also be capable of receiving signals from other types of transmitting sources such as a Bluetooth transmitter, a Wireless Fidelity (Wi-Fi) transmitter, a wireless local area network (WLAN) transmitter, an IEEE 802.11 transmitter, and any other suitable transmitter.

In FIG. 1, each terminal 110 is shown as receiving signals from multiple transmitting sources simultaneously, where a transmitting source may be a base station 120 or a satellite 130. In certain embodiments, a terminal 110 may also be a transmitting source. In general, a terminal 110 may receive signals from zero, one, or multiple transmitting sources at any given moment.

System 100 may be a Code Division Multiple Access (CDMA) system, a Time Division Multiple Access (TDMA) system, or some other wireless communication system. A CDMA system may implement one or more CDMA standards such as IS-95, IS-2000 (also commonly known as "1x"), IS-856 (also commonly known as "1xEV-DO"), Wideband-CDMA (W-CDMA), and so on. A TDMA system may implement one or more TDMA standards such as Global System for Mobile Communications (GSM). The W-CDMA standard is defined by a consortium known as 3GPP, and the IS-2000 and IS-856 standards are defined by a consortium known as 3GPP2.

Figure 2:
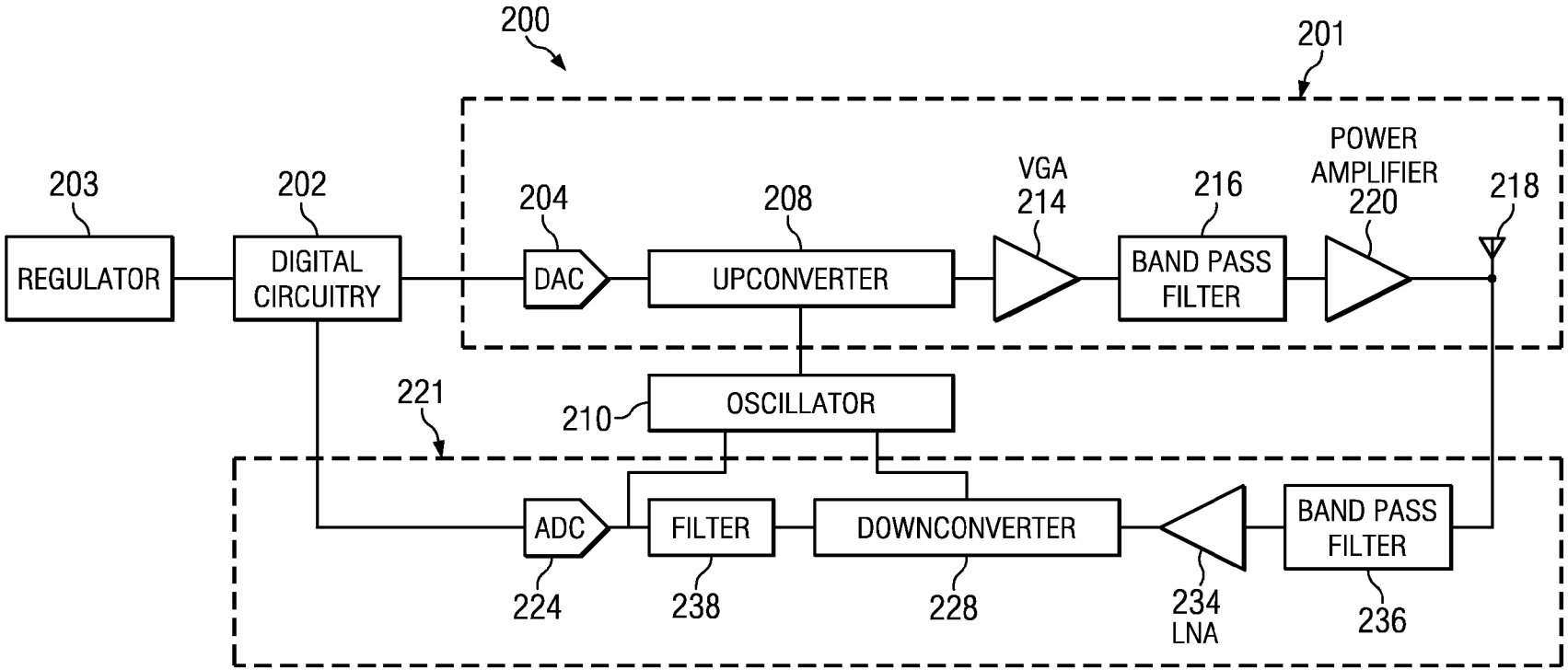
FIG. 2 illustrates an example block diagram of selected components of a transmitting and/or receiving element in accordance with certain embodiments of the present disclosure.

FIG. 2 illustrates a block diagram of selected components of an example transmitting and/or receiving element 200 (e.g., a terminal 110, a base station 120, or a satellite 130), in accordance with certain embodiments of the present disclosure. Element 200 may include a transmit path 201 and/or a receive path 221. Depending on the functionality of element 200, element 200 may be considered a transmitter, a receiver, or a transceiver.

Transmitting source 200 may include one or more voltage regulators 203. Voltage regulator 203 may comprise any system, apparatus or device configured to regulate the voltage supplied to one or more of the various circuits and components included in transmitting source 200. In some instances, voltage regulators 203 may comprise a low dropout (LDO) linear regulator. In the present example, voltage regulator 203 is depicted as providing power to digital circuitry 202. However, it is understood that transmitting source 200 may include other regulators configured to provide power to other components of transmitting source 200.

Digital circuitry 202 may include any system, device, or apparatus configured to process digital signals and information received via receive path 221, and/or configured to process signals and information for transmission via transmit path 201. Such digital circuitry 202 may include one or more microprocessors, digital signal processors, and/or other suitable devices.

Transmit path 201 may include a digital-to-analog converter (DAC) 204. DAC 204 may be configured to receive a digital signal from digital circuitry 202 and convert such digital signal into an analog signal. Such analog signal may then be passed to one or more other components of transmit path 201, including upconverter 208.

Upconverter 208 may be configured to frequency upconvert an analog signal received from DAC 204 to a wireless communication signal at a radio frequency based on an oscillator signal provided by oscillator 210. Oscillator 210 may be any suitable device, system, or apparatus configured to produce an analog waveform of a particular frequency for modulation or upconversion of an analog signal to a wireless communication signal, or for demodulation or downconversion of a wireless communication signal to an analog signal. In some embodiments, oscillator 210 may be a digitally-controlled crystal oscillator.

Transmit path 201 may include a variable-gain amplifier (VGA) 214 to amplify an upconverted signal for transmission, and a bandpass filter 216 configured to receive an amplified signal VGA 214 and pass signal components in the band of interest and remove out-of-band noise and undesired signals. The bandpass filtered signal may be received by power amplifier 220 where it is amplified for transmission via antenna 218. Antenna 218 may receive the amplified and transmit such signal (e.g., to one or more of a terminal 110, a base station 120, and/or a satellite 130).

Receive path 221 may include a bandpass filter 236 configured to receive a wireless communication signal (e.g., from a terminal 110, a base station 120, and/or a satellite 130) via antenna 218. Bandpass filter 236 may pass signal components in the band of interest and remove out-of-band noise and undesired signals. In addition, receive path 221 may include a low-noise amplifiers (LNA) 224 to amplify a signal received from bandpass filter 236.

Receive path 221 may also include a downconverter 228. Downconverter 228 may be configured to frequency downconvert a wireless communication signal received via antenna 218 and amplified by LNA 234 by an oscillator signal provided by oscillator 210 (e.g., downconvert to a baseband signal). Receive path 221 may further include a filter 238, which may be configured to filter a downconverted wireless communication signal in order to pass the signal components within a radio-frequency channel of interest and/or to remove noise and undesired signals that may be generated by the downconversion process. In addition, receive path 221 may include an analog-to-digital converter (ADC) 224 configured to receive an analog signal from filter 238 and convert such analog signal into a digital signal. Such digital signal may then be passed to digital circuitry 202 for processing.

As the performance requirements and capabilities of transmitting source 200 increase, the performance requirements and capabilities of voltage regulators 203 may also need to be increased. For example, digital circuitry 202 may include a clock synthesizer that includes a plurality of digital dividers. The clock synthesizer may be configured to generate a clocking signal at a particular frequency. The digital dividers may be configured to divide the clock frequency down to the operation frequencies of various components within the digital circuitry. The digital dividers may have very fast current pulses that must be sourced when the dividers switch from one divider to another. In the present example, voltage regulator 203 may be used to power the dividers and may comprise an LDO regulator. The fast switching between the digital dividers may require voltage regulator 203 to quickly respond to loads applied to the output of regulator 203, by the digital dividers. This quick response may reduce overshoot and undershoot of the output voltage.

By quickly responding to the change in load current, if a load (e.g., digital divider) is quickly applied to the output, regulator 203 may provide the appropriate amount of charge to the load when the load is applied without the output voltage significantly dropping or spiking during the rapid switching between loads. Accordingly, the degree that the output voltage of regulator 203 may drop below a desired nominal level may be reduced, thus reducing "undershoot" of the output voltage. Therefore, reduced performance caused by inadequate voltage being supplied to the loads may also be reduced. Similarly, by having a quick response time, regulator 203*b* may also reduce a spike in output voltage ("overshoot") when a load is quickly removed (e.g., a divider is switched off). Accordingly, problems such as damaged components due to too high of voltage being applied to those components may also be reduced.

Modifications, additions or omissions may be made to the system in FIG. 2 without departing from the scope of the disclosure. For example, although regulator 203 is depicted in the context of a transmitting source 200, regulator 203 may be included in any electrical device and may be configured to regulate the power of any suitable device. The current embodiment is not limited to merely wireless communications devices.

Figure 3:
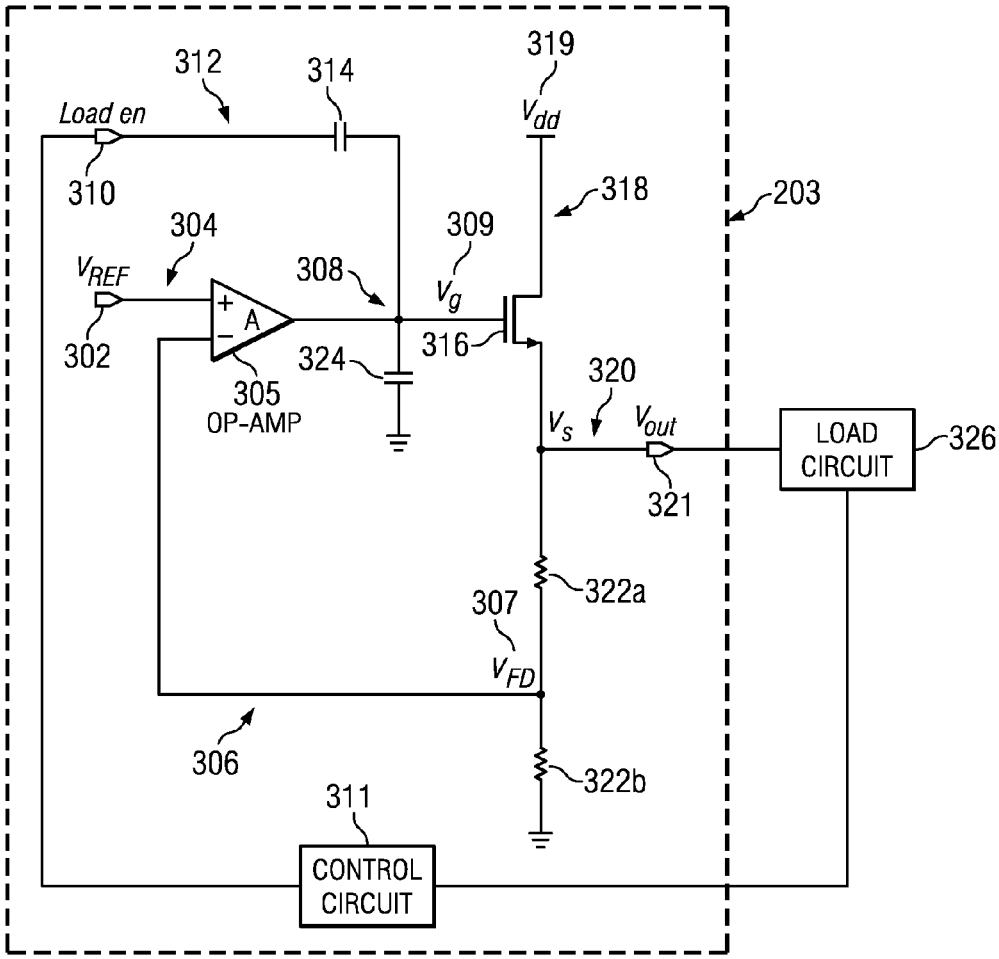
FIG. 3 illustrates an example schematic of a regulator configured to reduce the overshoot and undershoot of the output voltage of the regulator in accordance with certain embodiments of the present disclosure.

FIG. 3 illustrates an example schematic of a regulator 203 configured to reduce the overshoot and undershoot of the output voltage of regulator 203. In the present example, regulator 203 may include a low drop-out (LDO) regulator. Regulator 203 may include a reference node 304 having a reference voltage ($V_{ref}$) 302. Reference voltage 302 may comprise the input voltage used to establish the amount of output voltage ($V_{out}$) 321 at an output node 320 also included in regulator 203. Output node 320 and output voltage 321 may be configured to supply power to one or more load circuits 326 (e.g., a clock synthesizer, digital dividers, etc.). Due to the relationship between reference voltage 302 and output voltage 321, reference voltage 302 may be selected to provide the appropriate output voltage 321 to drive the one or more load circuits 326.

In the present example, regulator 203 may include an operational amplifier (op amp) 305 coupled to reference node 304 and configured to drive output voltage 321 according to reference voltage 302. The non-inverting terminal of op amp 305 may be coupled to reference node 304 such that the voltage received at the non-inverting terminal of op amp 305 may be approximately equal to reference voltage 302. The inverting terminal of op amp 305 may be coupled to a resistor 322*a* having a resistance ($R_a$) and a resistor 322*b* having a resistance ($R_b$) at a feedback node 306 having a feedback voltage ($V_{fb}$) 307. The other end of resistor 322*a* may be coupled to output node 320 and the other end of resistor 322*b* may be coupled to ground. Accordingly, resistors 322*a* and 322*b* may create a voltage divider between output node 320 and feedback node 306. Additionally, due to the high resistance between the inverting and non-inverting terminals of op amp 305, feedback voltage 307 may be approximately equal to reference voltage 302. Therefore, due to the voltage divider and op amp 305 characteristics, output voltage 321, feedback voltage 307, and reference voltage 302 may be related to each other as defined by the following equation:

$$V_{out}=V_{fb}*(1+R_a/R_b)\approx V_{ref}*(1+R_a/R_b)$$

Thus, by selecting appropriate resistive values for resistors 322*a* and 322*b* ($R_a$ and $R_b$ respectively) and reference voltage ($V_{ref}$) 302, the desired output voltage ($V_{out}$) 321 may be obtained.

Additionally, output node 320 may be coupled to a pass transistor 316. Pass transistor 316 may comprise any suitable transistor configured to supply current to output node 320. In the present example, pass transistor 316 may comprise an npn metal-oxide-semiconductor field-effect (MOSFET or NMOS) transistor. In the present example, pass transistor 316 may comprise a drain, a source and a gate. The drain of pass transistor 316 may be coupled to a supply node 318 having a supply voltage ($V_{dd}$) 319. Supply node 318 may provide the appropriate power to supply current to flow through pass transistor 316. The amount of current that may pass through pass transistor 316 from the drain to the source to provide current to output node 320 may be proportional to the voltage difference between the gate and source of pass transistor 316 ($V_{gs}$). Accordingly, the value of $V_{gs}$ may increase if the amount of current passing through pass transistor 316 increases. Additionally, the value of $V_{gs}$ may decrease if the amount of current passing through pass transistor 316 decreases.

In the current example, op amp 305, transistor 316 and resistors 322*a* and 322*b* may be configured to ensure that the value of $V_{gs}$ is such that pass transistor 316 provides the appropriate amount of current and voltage to output node 320. The source of pass transistor 316 ($V_s$) may be coupled to output node 320 such that the voltage at the source of pass transistor 316 may approximately equal output voltage ($V_{out}$) 321. Additionally, by having the source being coupled to output node 320, the current passing through pass transistor 316 may provide the current to circuits coupled to output node 320. As noted above, output voltage 321 (and therefore, the voltage at the supply of pass transistor 316) may be related to reference voltage 302 due to the feedback configuration of the inverting terminal of op amp 305.

The gate of pass transistor 316 may be coupled to the output of op amp 305 at a gate node 308 having a gate voltage ($V_g$) 309. As noted above, the amount of current that may pass through pass transistor 316 may depend on $V_{gs}$, which may be the difference between gate voltage ($V_g$) 309 and the voltage at the source ($V_s$) ($V_{gs}=V_g-V_s$). Additionally, $V_s$ may be approximately equal to output voltage 321, therefore ($V_{gs}\approx V_g-V_{out}$). Accordingly, if the amount of current passing through pass transistor 316 increases, $V_g$ 309 may increase, $V_{out}$ 321 may decrease, or both. Additionally, if the amount of current passing through pass transistor 316 decreases, $V_g$ 309 may decrease, $V_{out}$ 321 may increase, or both.

Also, as mentioned earlier, $V_{out}$ 321 may be related to $V_{fb}$ 307, and op amp 305 may be configured to maintain that the voltage at the inverting terminal of op amp 305 ($V_{fb}$ 307) approximately equals the voltage of op amp 305 at its non-inverting terminal ($V_{ref}$ 302). Op amp 305 may maintain that $V_{ref}$ 302 and $V_{fb}$ 307 are approximately equal by adjusting the output voltage, which in turn may adjust $V_g$ 309. Accordingly, op amp 305 may be configured to maintain $V_{out}$ 321 by adjusting $V_g$ in response to any current changes at output node 320, instead of allowing $V_{out}$ 321 to change in response to any current changes at output node 320. This configuration may help ensure that the appropriate amount of voltage ($V_{out}$ 321) is supplied to load circuits 326 by output node 320. Regulator 203 may also include a capacitor 324 coupled to gate node 308 at one end and coupled to ground at its other end. Capacitor 324 may be configured to provide a degree of stability to the output of op amp 305 and thus stabilize $V_g$ 309 by not allowing instantaneous changes in voltage between its two ends.

However, op amp 305 may not be able to instantaneously adjust $V_g$ in response to a change in current at output node 320. Accordingly, regulator 203 may also include an overshoot/undershoot regulation circuit to provide a faster adjustment to $V_g$ while op amp 305 adjusts to changes in current at output node 320 due to changes in loads applied, etc. For example, when a load is applied to output node 320 by load circuit 326, the overshoot/undershoot regulation circuit may increase $V_g$ 309 while op amp 305 adjusts its output according to the increased current demand. Thus, the overshoot/undershoot regulation circuit may raise the $V_{gs}$ of pass transistor 316 to compensate for the additional current and therefore, reduce a drop (e.g., undershoot) in $V_{out}$ 321. Similarly, when a load is removed from output node 320, the overshoot/undershoot regulation circuit may decrease $V_g$ 309 while op amp 305 adjusts its output according to the decreased current demands. Thus, the overshoot/undershoot regulation circuit may decrease $V_{gs}$ of pass transistor 316 to compensate for the reduced current flow and therefore, reduce an increase (e.g., overshoot) in $V_{out}$ 321.

The overshoot/undershoot regulation circuit may include a control capacitor 314 and a control circuit 311. Control circuit 311 may be coupled to load circuit 326 and control node 312, such that control circuit 311 may set the voltage at control node 312 based on whether load circuit 326 applies a load to output node 320. Additionally, one terminal of control capacitor 314 may be coupled to control node 312 and the other terminal of control capacitor 314 may be coupled to gate node 308. Control capacitor 314 may be configured with control circuit 311, and capacitor 324 to temporarily adjust $V_g$ 309, and therefore temporarily adjust $V_{gs}$, while op amp 305 adjusts to a load being applied to or removed from output node 320.

Control circuit 311 may be configured to set a control signal 310 (Load_en) to a "low" state or a "high" state. In the present embodiment, control signal 310 may comprise a voltage applied at control node 312 as dictated by control circuit 311. Control circuit 311 may be configured to set control signal 310 "low" by coupling control node 312 to a low voltage node (e.g., ground) thus, transitioning the voltage applied at control node 312 (e.g., control signal 310) to a "low" voltage. Control circuit 311 may also be configured to set control signal 310 "high" by coupling control node 312 to a high voltage node (e.g., supply node 318 having a supply voltage of $V_{dd}$ 319) thus, transitioning the voltage applied at control node 312 (e.g., control signal 310) to a "high" voltage. Therefore, the voltage of control signal 310 in its "high" state may be higher than the voltage of control signal 310 in its "low" state.

Control circuit 311 may be configured to transition control signal 310 from "low" to "high" when a load is applied to output node 320. Additionally, control circuit 311 may be configured to transition control signal 310 from "high" to "low" when the load is removed from output node 320. In the present embodiment, the term "applying a load" at output node 320 is used to denote load circuit 326 drawing a current from output node 320. Additionally, the term "removing a load" at output node 320 is used to denote load circuit 326 no longer drawing a current from output node 320. This application and removal of a load may be accomplished in any suitable manner, such as activating a switch that connects or disconnects the load from output node 320.

In some embodiments, control circuit 311 may be coupled to load circuit 326 and may be configured to determine to set control signal 310 "high" or "low" when a load is to be applied or removed at output node 320. In some embodiments, control circuit 311 may comprise a controller including a processor and logic configured to determine how to set control signal 310. In other embodiments, control circuit 311 may be coupled to a switch associated with the load such that control signal 310 may automatically go from "high" to "low" or vice versa upon load circuit 326 applying a load or removing a load at output node 320.

In the present example, when control signal 310 goes from "low" to "high" or from "high" to "low," the voltage at control node 312 may change from ground to $V_{dd}$ 319 or from $V_{dd}$ 319 to ground respectively. However, to prevent the voltage across control capacitor 314 from changing instantaneously, control capacitor 314 may discharge some current to cause $V_g$ 309 to rise or fall instantaneously. For example, when control signal 310 goes "high," control capacitor 314 may discharge current toward control node 312 to raise the voltage of $V_g$ 309. Alternatively, when control signal 310 goes "low," control capacitor 314 may discharge current toward gate node 308 to lower the voltage of $V_g$ 309.

The change in $V_g$ 309 may be related to the difference between the "high" voltage and the "low" voltage of control signal 310 and the ratio between the capacitance of capacitors 314 and 324. In the present configuration, the change in $V_g$ 309 may be related to the capacitance of control capacitor 314 with respect to the capacitance of capacitor 324 such that the smaller the capacitance of control capacitor 314 with respect to the capacitance of capacitor 324, the smaller the change in $V_g$ 309 and vice versa. Additionally, the change in $V_g$ 309 may be directly proportional to the difference between the "high" voltage value and the "low" voltage value of control signal 310, such that the smaller the difference, the smaller the change in $V_g$ 309 and vice versa. In the present example, with $V_{dd}$ 319 being the "high" voltage and ground being the "low" voltage, the smaller the voltage of $V_{dd}$ 319, the smaller the change in $V_g$ 309 and vice versa. In the present example, $V_{dd}$ 319 and the capacitance of capacitor 324 may not be changed, therefore, the change in $V_g$ 309 when control signal 310 changes states may be dictated by determining an appropriate capacitance for control capacitor 314.

The size of control capacitor 314 be based on the amount of load current being applied or removed due to control capacitor 314 adjusting $V_g$ 309. As noted earlier, the amount that $V_g$ 309 may change when a load is applied or removed may be based on the increase or decrease of current at output node 320 due to the load being applied or removed at output node 320. Therefore, because the amount of change in $V_g$ 309 may be related to the size of control capacitor 314 and because the amount of change in $V_g$ 309 needed to reduce overshoot or undershoot may be related to the amount of load current, the size of control capacitor 314 may be based on the load current. Accordingly, control capacitor 314 may be sized such that $V_g$ 309 appropriately changes while $V_{out}$ 321 remains fairly constant while meeting the current demands—thus, reducing overshoot or undershoot.

The appropriate size for control capacitor 314 may be determined by running simulations with different capacitances and load currents to identify which capacitances work well for reducing overshoot and undershoot with respect to different load currents. In alternative embodiments, the capacitance of control capacitor 314 may be determined using equations and principles known in the art.

Modifications, additions or omissions may be made to regulator 203 described in FIG. 3 without departing from the scope of the disclosure. For example, regulator 203 is depicted with specific components and configurations to regulate $V_{out}$ 321. However, any suitable voltage regulator with an overshoot/undershoot regulation configuration that comprises control signal 310 and control capacitor 314 may be implemented to reduce the overshoot or undershoot of $V_{out}$ 321.

Additionally, control signal 310 is described as being tied to ground or $V_{dd}$ when it is respectively "low" or "high." However, any configuration of control signal 310 with control capacitor 314 that may cause control capacitor 314 to temporarily and appropriately adjust the output voltage of a voltage regulator to reduce overshoot and undershoot may be implemented within the scope of the present disclosure.

Further, control circuit 311 is depicted as being directly coupled to load circuit 326, but the disclosure should not be limited to such. Control circuit 311 may be configured in any manner with respect to load circuit 326 to allow control circuit 311 to determine when to set control signal 310 "high" or "low."

Figure 4:
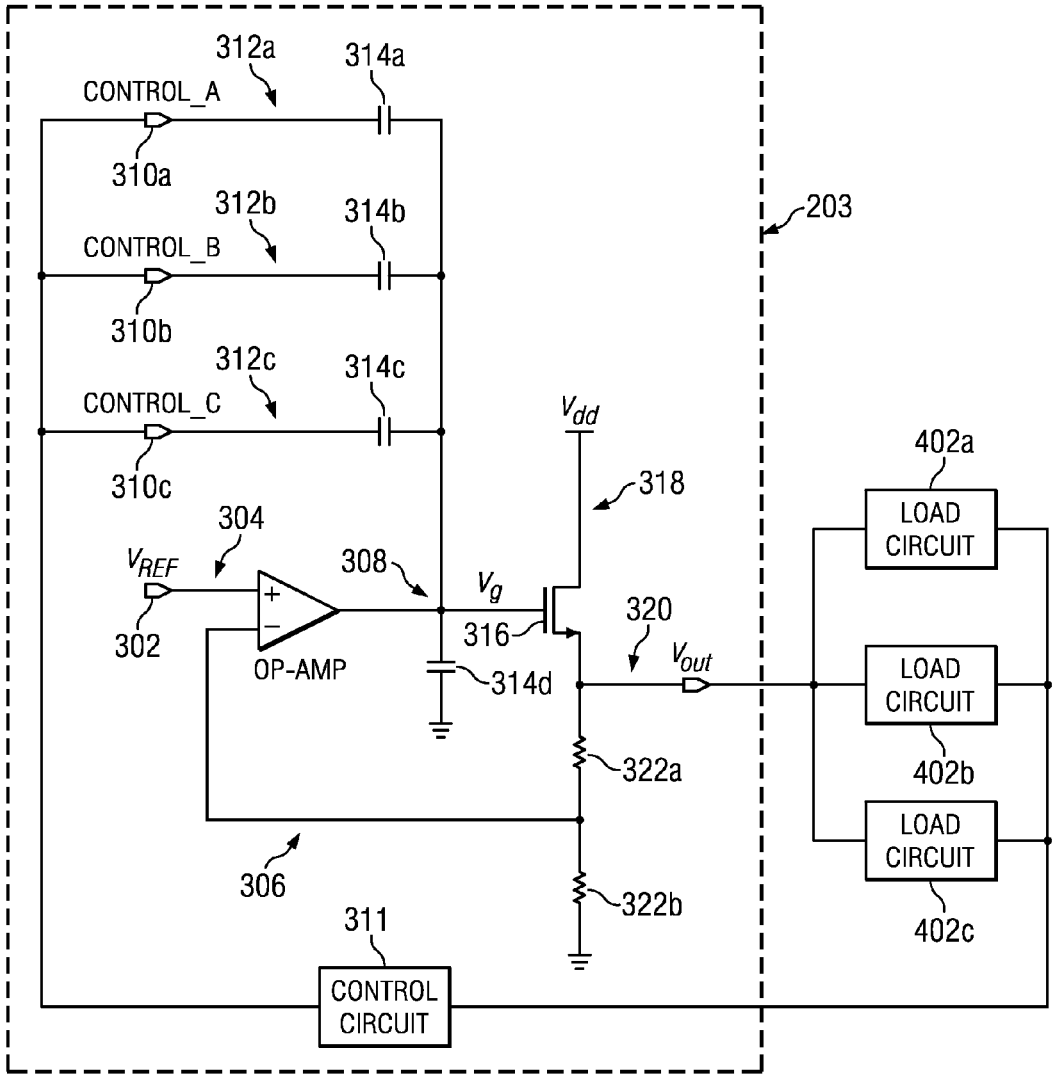
FIG. 4 illustrates an example schematic of a regulator configured to reduce the overshoot and undershoot of the output of a voltage regulator coupled to a plurality of load circuits having different load currents in accordance with certain embodiments of the present disclosure.

FIG. 4 illustrates an example schematic of a regulator 203 configured to reduce the overshoot and undershoot of the output of a voltage regulator coupled to a plurality of load circuits having different load currents. Regulator 203 of FIG. 4 may be substantially similar to regulator 203 of FIG. 3, but with a plurality of control signals 310 and capacitors 314, each associated with one of the plurality of load circuits.

As mentioned above, the amount of overshoot or undershoot of a load circuit may depend on the amount of load current of a particular load being applied or removed from an output node 320. Therefore, a regulator 203 coupled to and configured to drive a plurality of load circuits 402, having a plurality of load currents, may be configured to reduce the overshoot and undershoot of each load 402 according to the load current of each load 402.

A regulator 203 configured to reduce the overshoot and undershoot of a plurality of loads—each load having a load current—may comprise a plurality of control signals 310 and capacitors 314 configured according to the load currents of each load. For example, in the present embodiment, regulator 203 may be coupled to load 402*a*, load 402*b* and load 402*c*, and each of loads 402 may have a load current. Accordingly, regulator 203 may comprise a control signal 310 and control capacitor 314 associated with each load 402. For example, regulator 203 may include a control signal 310*a* and control capacitor 314*a* associated with load 402*a*, a control signal 310*b* and control capacitor 314*b* associated with load 402*b*, and a control signal 402*c* and control capacitor 314*c* associated with load 402*c*.

Control circuit 311 may be configured to set each control signal 310 "high" when its respective load 402 is applied to output node 320. Control circuit 311 may also be configured to set each control signal 310 "low" when its respective load 402 is removed from output node 320. For example, control circuit 311 may be configured to set control signal 310*a* "high" when load 402*a* is applied to output node 320 and may be configured to set control signal 310 "low" when load 402*a* is removed from output node 320, etc.

Additionally, each control capacitor 314 may be configured to have the appropriate amount of capacitance to compensate for overshoot or undershoot of $V_{out}$ when its respective load 402 is applied or removed from output node 320. As noted earlier, the appropriate capacitance of a control capacitor 314 may be associated with the amount of load current, therefore, each control capacitor 314 may be sized according to the load current of its respective load 402. Therefore, a regulator 203 may be configured to reduce the overshoot and undershoot when a plurality of loads 402 may be coupled to the regulator 203.

Modifications, additions or omissions may be made to the system of FIG. 4 without departing from the scope of the present disclosure. For example, although three loads 402, three control signals 310 and three capacitors 314 are shown, regulator 203 may be coupled to any number of loads 402 and may include any number of control signals 310 and capacitors 314 without departing from the scope of the disclosure.

Additionally, although FIG. 4 depicts one control circuit 311, control circuit 311 may comprise a plurality of control circuits 311. Each of the plurality of control circuits 311 may be associated with one or more of control signals 310 and capacitors 314.

Figure 5:
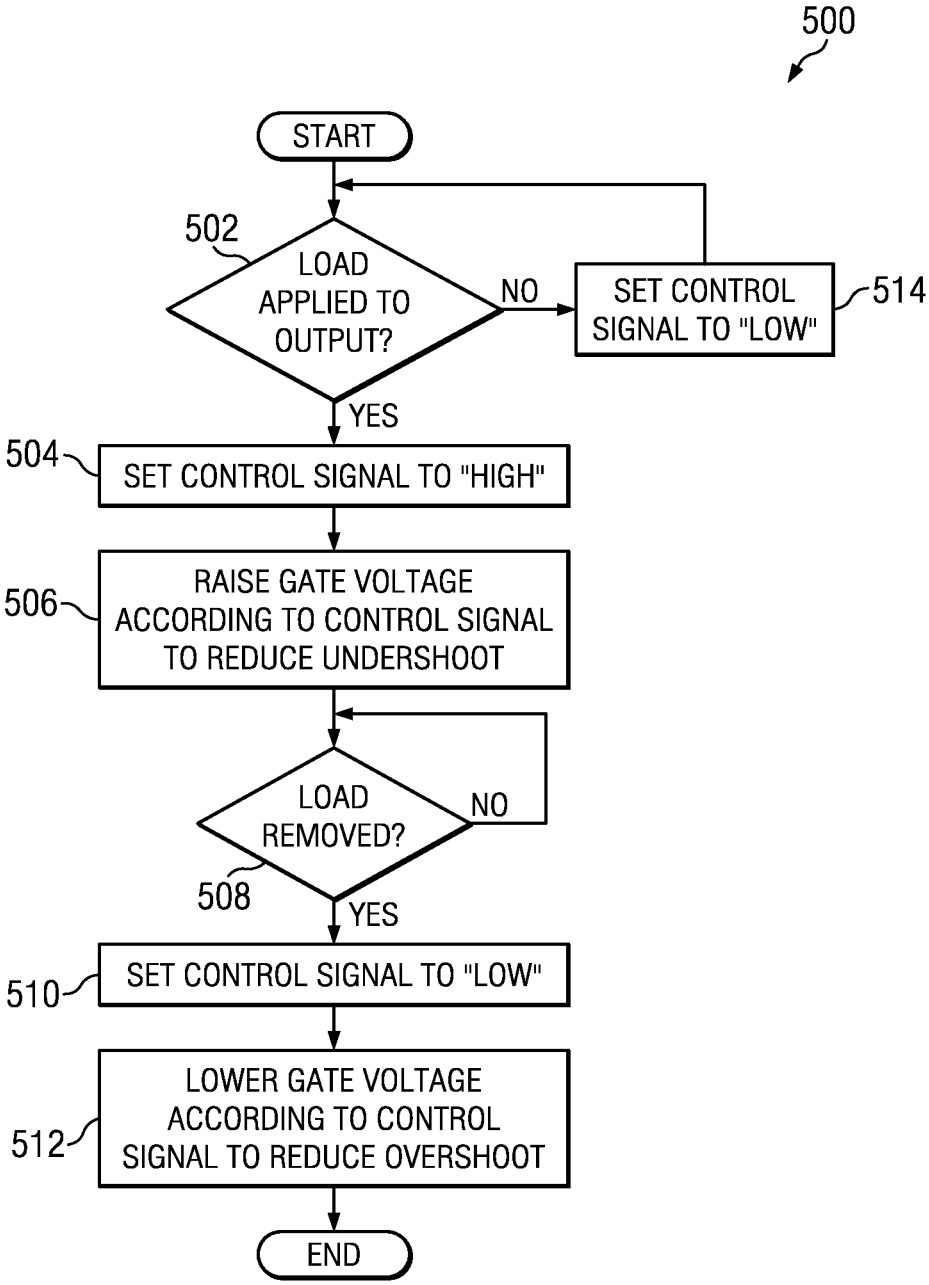
FIG. 5 illustrates an example method for reducing overshoot and undershoot of a voltage regulator in accordance with certain embodiments of the present disclosure.

FIG. 5 illustrates an example method 500 for reducing overshoot and undershoot of a voltage regulator. Method 500 may begin at step 502, where a regulator may determine whether or not a load is applied to the output node of the regulator. The regulator may include a control unit configured to control the application of a load to the regulator and thus also configured to determine whether a load has been applied to the output of the regulator. If a load is applied to the output of the regulator, method 500 may *proceed* to step 504. Otherwise, method 500 may *proceed* to step 514, where the regulator may set the control signal to "low" and return to step 502.

At step 504, the regulator may set the control signal to "high." At step 506, a capacitor (e.g., control capacitor 314) of the regulator may raise the gate voltage of a pass transistor in response to the control signal being set "high." By quickly raising the gate voltage of the pass transistor, the regulator may reduce the amount of voltage undershoot while other components (e.g., op amp 305) adjust to the change in current caused by the load being applied to the output node which may also cause voltage undershoot.

At step 508, the regulator may determine if the load has been removed from the output node of the regulator. If the load has not been removed, method 500 may repeat step 508. If the load has been removed, method 500 may *proceed* to step 510.

At step 510, the regulator may set the control signal to "low." At step 512, in response to the control signal being set "low" the capacitor of the regulator may quickly lower the gate voltage. By quickly lowering the gate voltage, the capacitor may reduce the amount of voltage overshoot while other components (e.g., op amp 305) adjust to the change in current caused by the load being removed from the output node—removal of which may cause voltage overshoot. Following step 512, the method may end.

Modifications, additions, or omissions may be made to method 500 without departing from the scope of the present disclosure. For example, although step 502 describes an affirmative determination by a control unit of whether a load has been applied to the output of the regulator, this determination may be made passively by having the control signal linked to the load such that the control signal automatically goes either "high" or "low" when the load is applied or removed from the output. Step 508 may be accomplished in a similar manner.

Although the present disclosure and its advantages have been described in detail, it should be understood that various changes, substitutions and alterations can be made herein without departing from the spirit and scope of the disclosure as defined by the following claims.

What is claimed is:

1. An undershoot/overshoot regulation circuit comprising:

a control node having a control voltage;

a control circuit configured to increase the control voltage in response to a load being applied to an output node of a voltage regulator, and decrease the control voltage in response to the load being removed from the output node; and a control capacitor including a first terminal coupled to the control node and a second terminal coupled to a gate node of the voltage regulator, wherein the control capacitor is configured to increase a gate voltage at the gate node in response to the increase of the control voltage, and decrease the gate voltage in response to the decrease of the control voltage.

2. The circuit of claim 1, wherein an output voltage at the output node comprises a function of the gate voltage and wherein the control capacitor is configured to increase the gate voltage by approximately a voltage undershoot of the output voltage occurring as a result of the load being applied to the output node.

3. The circuit of claim 1, wherein an output voltage at the output node comprises a function of the gate voltage and wherein the control capacitor is configured to decrease the gate voltage by approximately a voltage overshoot of the output voltage occurring as a result of the load being removed from the output node.

4. The circuit of claim 1, wherein an output voltage at the output node comprises a function of the gate voltage and a load current of the load circuit and wherein the control capacitor is configured to increase and decrease the gate voltage based at least on the load current.

5. The circuit of claim 1, wherein the load comprises a clock synthesizer.

6. The circuit of claim 1, wherein the load comprises a digital divider.

7. The circuit of claim 1, wherein the control capacitor is configured to increase and decrease the gate voltage based at least on a capacitance of a stabilizing capacitor coupled to the gate node and ground.

8. A system comprising:

a voltage regulator comprising a gate node having a gate voltage and an output node having an output voltage; and an undershoot/overshoot regulation circuit comprising:

a control node having a control voltage;

a control circuit configured to increase the control voltage in response to a load being applied to the output node, and decrease the control voltage in response to the load being removed from the output node; and a control capacitor including a first terminal coupled to the control node and a second terminal coupled to the gate node, wherein the control capacitor is configured to increase the gate voltage in response to the increase of the control voltage, and decrease the gate voltage in response to the decrease of the control voltage.

9. The system of claim 8, wherein the output voltage comprises a function of the gate voltage and wherein the control capacitor is configured to increase the gate voltage by approximately a voltage undershoot of the output voltage occurring as a result of the load being applied to the output node.

10. The system of claim 8, wherein the output voltage comprises a function of the gate voltage and wherein the control capacitor is configured to decrease the gate voltage by approximately a voltage overshoot of the output voltage occurring as a result of the load being removed from the output node.

11. The system of claim 8, wherein the output voltage comprises a function of the gate voltage and a load current of the load circuit and wherein the control capacitor is configured to increase and decrease the gate voltage based at least on the load current.

12. The system of claim 8, wherein the load comprises a clock synthesizer.

13. The system of claim 8, wherein the load comprises a digital divider.

14. The system of claim 8, further comprising a stabilizing capacitor coupled to the gate node and ground and wherein the control capacitor is configured to increase and decrease the gate voltage based at least on a capacitance of the stabilizing capacitor.

15. A method comprising:

increasing, by a control circuit, a control voltage at a control node of a voltage undershoot/overshoot regulation circuit in response to a load being applied to an output node of a voltage regulator;

decreasing, by the control circuit, the control voltage in response to the load being removed from the output node;

increasing, by a control capacitor, a gate voltage at a gate node of the voltage regulator in response to the increase of the control voltage; and decreasing the gate voltage in response to the decrease of the control voltage.

16. The method of claim 15, wherein the output voltage comprises a function of the gate voltage and wherein the method further comprises increasing the gate voltage by approximately a voltage undershoot of the output voltage occurring as a result of the load being applied to the output node.

17. The method of claim 15, wherein the output voltage comprises a function of the gate voltage and wherein the method further comprises decreasing the gate voltage by approximately a voltage overshoot of the output voltage occurring as a result of the load being removed from the output node.

18. The method of claim 15, wherein the output voltage comprises a function of the gate voltage and a load current of the load circuit and wherein the method further comprises increasing and decreasing the gate voltage based at least on the load current.

19. The method of claim 15, further comprising increasing and decreasing the gate voltage based on a capacitance of a stabilizing capacitor coupled to the gate node and ground.

20. The method of claim 15, wherein the load comprises at least one of a clock synthesizer and a digital divider.

* * * * *